US007811154B2

(12) United States Patent
Ling et al.

(10) Patent No.: US 7,811,154 B2
(45) Date of Patent: Oct. 12, 2010

(54) GRINDING APPARATUS

(75) Inventors: Wei-Cheng Ling, Taipei Hsien (TW); Da-Wei Lin, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 5 days.

(21) Appl. No.: 12/249,592

(22) Filed: Oct. 10, 2008

(65) Prior Publication Data

US 2009/0239452 A1 Sep. 24, 2009

(30) Foreign Application Priority Data

Mar. 24, 2008 (CN) ..... 2008 1 0300682

(51) Int. Cl.
*B24B 7/00* (2006.01)

(52) U.S. Cl. ..... 451/241; 451/246; 451/385; 451/396; 451/331; 451/335; 269/71; 269/73

(58) Field of Classification Search ..... 451/178, 451/241, 242, 246, 331, 333, 334, 335, 364, 451/379, 385, 398, 914; 269/43, 45, 71, 269/73

See application file for complete search history.

(56) References Cited

U.S. PATENT DOCUMENTS

| | | | | | |
|---|---|---|---|---|---|
| 2,059,895 | A * | 11/1936 | Norton et al. | ..... | 451/244 |
| 3,665,656 | A * | 5/1972 | Newsome | ..... | 451/334 |
| 3,680,267 | A * | 8/1972 | Vale et al. | ..... | 451/335 |
| 3,824,744 | A * | 7/1974 | Petrant | ..... | 451/387 |
| 4,072,476 | A * | 2/1978 | Kulson | ..... | 451/335 |
| 2007/0161336 | A1 * | 7/2007 | Yen | ..... | 451/28 |

* cited by examiner

*Primary Examiner*—Eileen P. Morgan
(74) *Attorney, Agent, or Firm*—Andrew C. Cheng

(57) ABSTRACT

A grinding apparatus for grinding workpieces includes two clamping rods and a base. Each of the two clamping rods has a first end and an opposite second end. The first ends are opposite to each other for clamping workpieces therebetween. The base includes a receiving groove for receiving the workpieces therein and two positioning slots at opposite sides of the receiving groove. The positioning slots are aligned with each other and configured for receivingly engaging with the clamping rods to align the clamping rods with each other.

10 Claims, 5 Drawing Sheets

GRINDING APPARATUS

CROSS-REFERENCE TO RELATED APPLICATIONS

This application is related to a commonly-assigned copending application Ser. No. 12/178,819, filed on Jul. 24, 2008, entitled "Grinding Apparatus Having Pressing Portion and Grinding Method Using same". Disclosure of the above-identified application is incorporated herein by reference in its entirety.

BACKGROUND

1. Technical Field

The present invention relates to a grinding apparatus for shaping a contour of a workpiece, e.g. an optical filter.

2. Description of Related Art

A roll grinder is generally utilized to round and/or polish a surface of a workpiece. A typical roll grinder includes a pair of hollow chambers. In a grinding process, air in the hollow chambers is pumped out/evacuated so as to create suction to hold a workpiece in place. The workpiece is then ground using a grinding wheel. However, this grinder is not very efficient because the grinder can only be used to shape one workpiece at a time.

Another typical roll grinding apparatus includes a pair of clamping members, a pair of drivers respectively connected to the clamping members, and a grinding wheel. In a roll grinding process, the clamping members cooperate to clamp a number of stacked workpieces being treated. The drivers drive the clamping members to rotate around a rotary axis thereof. During rotating, the workpieces clamped by the clamping members are rounded by the grinding wheel.

In general, to ensure the roll grinding precision of the workpieces, it is necessary for a principal axis of the workpieces to be coaxial with the rotary axis of the driver. However, the workpieces are usually mounted between the clamping members manually. Thus, the principal axis of the workpieces and the rotary axes of the drivers may undergo a positional excursion, thereby affecting the roll grinding precision of the workpieces.

What is needed, therefore, is a grinding apparatus can overcome the above shortcomings.

SUMMARY

A grinding apparatus for grinding workpieces includes two clamping rods and a base. Each of the two clamping rods has a first end and an opposite second end. The first ends are opposite to each other for clamping workpieces therebetween. The base includes a receiving groove for receiving the workpieces therein and two positioning slots at opposite sides of the receiving groove. The positioning slots are aligned with each other and configured for receivingly engaging with the clamping rods to align the clamping rods with each other.

Other advantages and novel features of the present grinding apparatus will become more apparent from the following detailed description of preferred embodiments, when taken in conjunction with the accompanying drawings.

BRIEF DESCRIPTION OF THE DRAWINGS

Many aspects of the present grinding apparatus can be better understood with reference to the following drawings. The components in the drawing are not necessarily drawn to scale, the emphasis instead being placed upon clearly illustrating the principles of the present grinding apparatus. Moreover, in the drawings, like reference numerals designate corresponding parts throughout the several views.

DETAILED DESCRIPTION OF THE EMBODIMENTS

Embodiments of the present grinding apparatus will now be described in detail below and with reference to the drawings.

Figure 1:
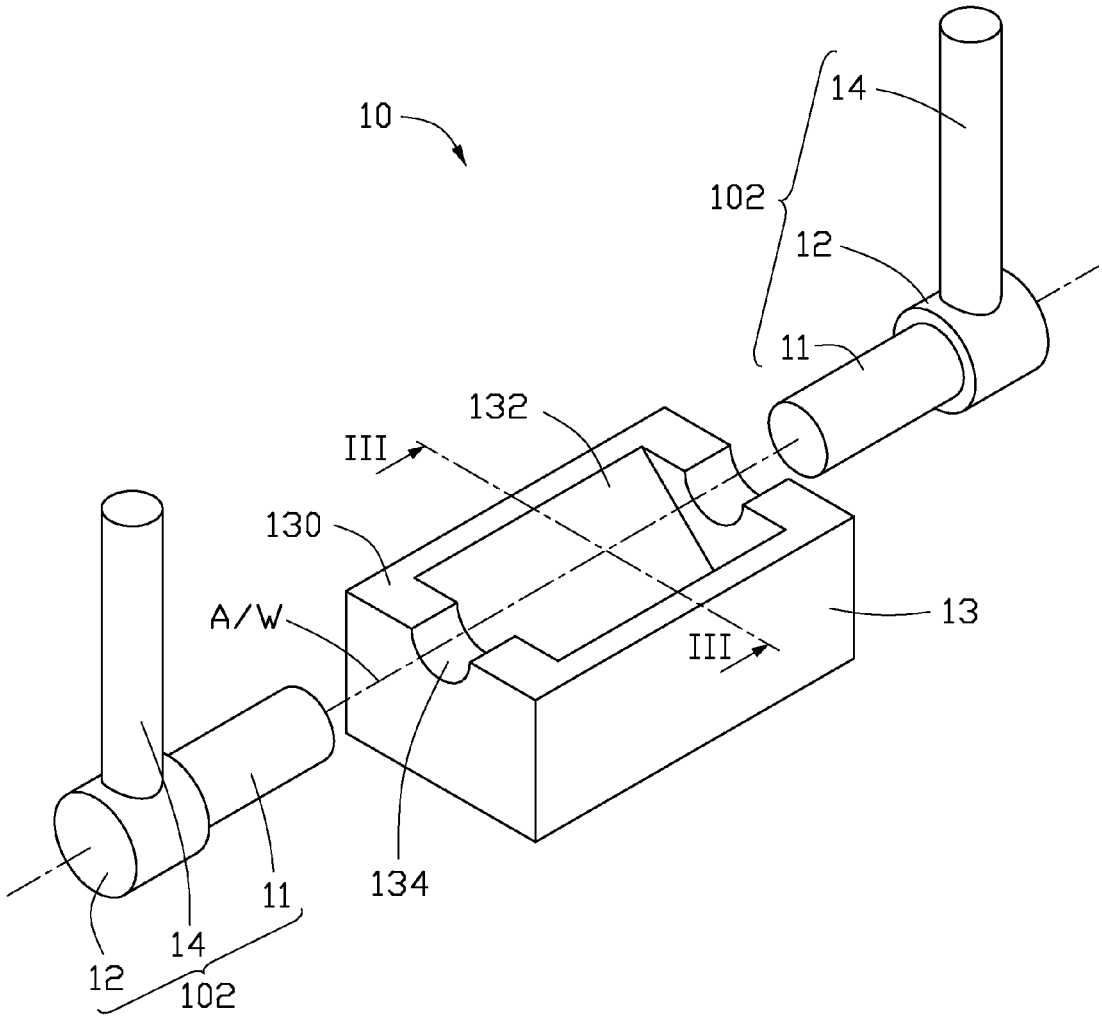
FIG. 1 is a schematic, isometric view of an embodiment of a grinding apparatus, wherein the grinding apparatus includes a base.
Figure 2:
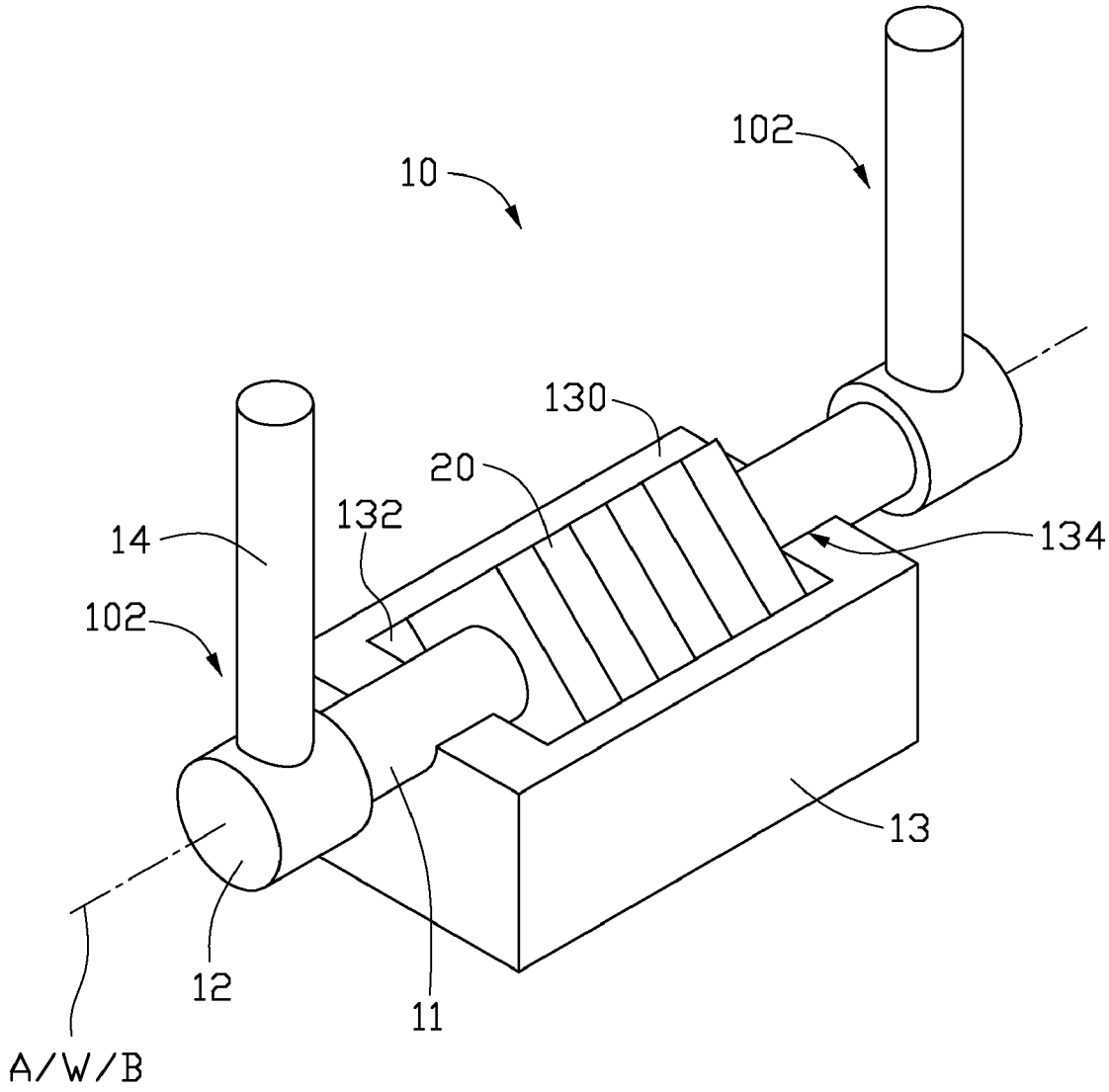
FIG. 2 is similar to FIG. 1, but showing the grinding apparatus holding a plurality of workpieces therein.

Referring to FIGS. 1 and 2, a grinding apparatus 10 includes two holding units 102 and a base 13. The base 13 is configured for receiving workpieces 20. In the illustrated embodiment, the grinding apparatus 100 is configured for grinding a plurality of rectangular workpieces 20 into round workpieces 20.

The holding unit 102 includes a clamping rod 11, a rotation driving member 12, and a linear driving member 14. The two holding units 102 are configured to hold the workpieces 20 between the two clamping rods 11. The clamping rod 11 has a principal axis A. In the illustrated embodiment, the clamping rod 11 has a cylindrical shape. The shape of the clamping rod 11 can also be prism-like. The rotation driving member 12 is connected to a distal end of the clamping rod 11. The rotation driving member 12 is configured for driving the clamping rod 11 to rotate about the principal axis A of the clamping rod 11. The rotation driving member 12 can be a rotary cylinder or a servo motor. The linear driving member 14 is connected with the rotation driving member 12 for driving the rotation driving member 12 to move along linear directions, for example move towards and away from the base 13 and move along a direction perpendicular with the principal axis A of the clamping rod 11.

The base 13 includes a receiving groove 132 configured for receiving the workpieces 20. Two positioning slots 134 are arranged at opposite sides of the receiving groove 132, respectively, and in communication with the receiving groove 132. The receiving groove 132 and the two positioning slots 134 are all defined in a surface 130 of the base. The two positioning slots 134 extend along the same direction as the receiving groove 132. The workpieces 20 to be ground could be, for example, square optical filters, square lenses, or other optoelectronic elements. For example, the receiving groove 132 may be V-shaped for holding the workpiece having at least one V-shaped corner. In the illustrated embodiment, the receiving groove 132 is defined by two inclined surfaces (not labeled) forming an angle of about 90 degrees. A plurality of workpieces 20 is received in the receiving groove 132 coaxially aligned and contacting each other. The principal axis of the workpieces 20 is indicated with reference letter B in FIG. 2. In this embodiment, each of the workpieces 20 is square shaped.

Figure 3:
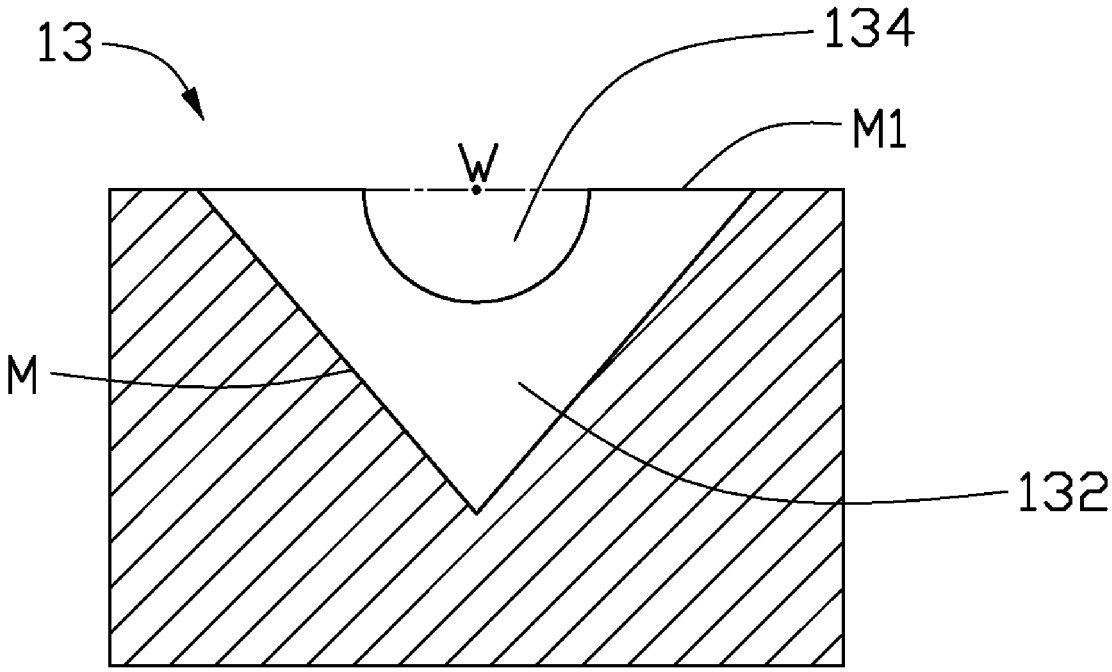
FIG. 3 is a cross-sectional view of the base of FIG. 1, taken along line III-III.

Referring also to FIG. 3, a cross-section of the receiving groove 132 is indicated as an isosceles right triangle in FIG. 3 matching in shape of a portion of the workpieces 20. Each of the positioning slots 134 has a U-shape with a constant radius of curvature and a principal axis W substantially coaxial with the principal axis B of the workpiece 20. The radius of curvature of the positioning slot 134 substantially equals to that of the clamping rod 11 to matingly contact the clamping rod 11.

In addition, when the size of the workpieces is changed, the position of the positioning slot 134 can be changed in a manner that the principal axis of the positioning slot 134 is substantially coaxial with the principal axis of workpieces 20. Also, the shaped of the cross-section of the positioning slot can be changed based on the change of the shape of the clamping rod 11.

In operation, the two clamping rods 11 partly enters into the two positioning slots 134, respectively, and each clamping rod 11 matingly contact a respective surface of the positioning slot 134. Then the clamping rods 11 are driven to clamp the workpieces 20 received in the receiving groove 132. The two clamping rods 11 each contacts one of the workpieces 20. The compression force applied to the workpieces 20 by the two clamping rods 11 hold the workpieces 20 between the two clamping rods 11. Because the radius of the positioning slot 134 substantially equals to that of the clamping rod 11, the clamping rod 11 is coaxial with the positioning slot 134, thus the clamping rod 11 is aligned with the workpieces 20.

Figure 4:
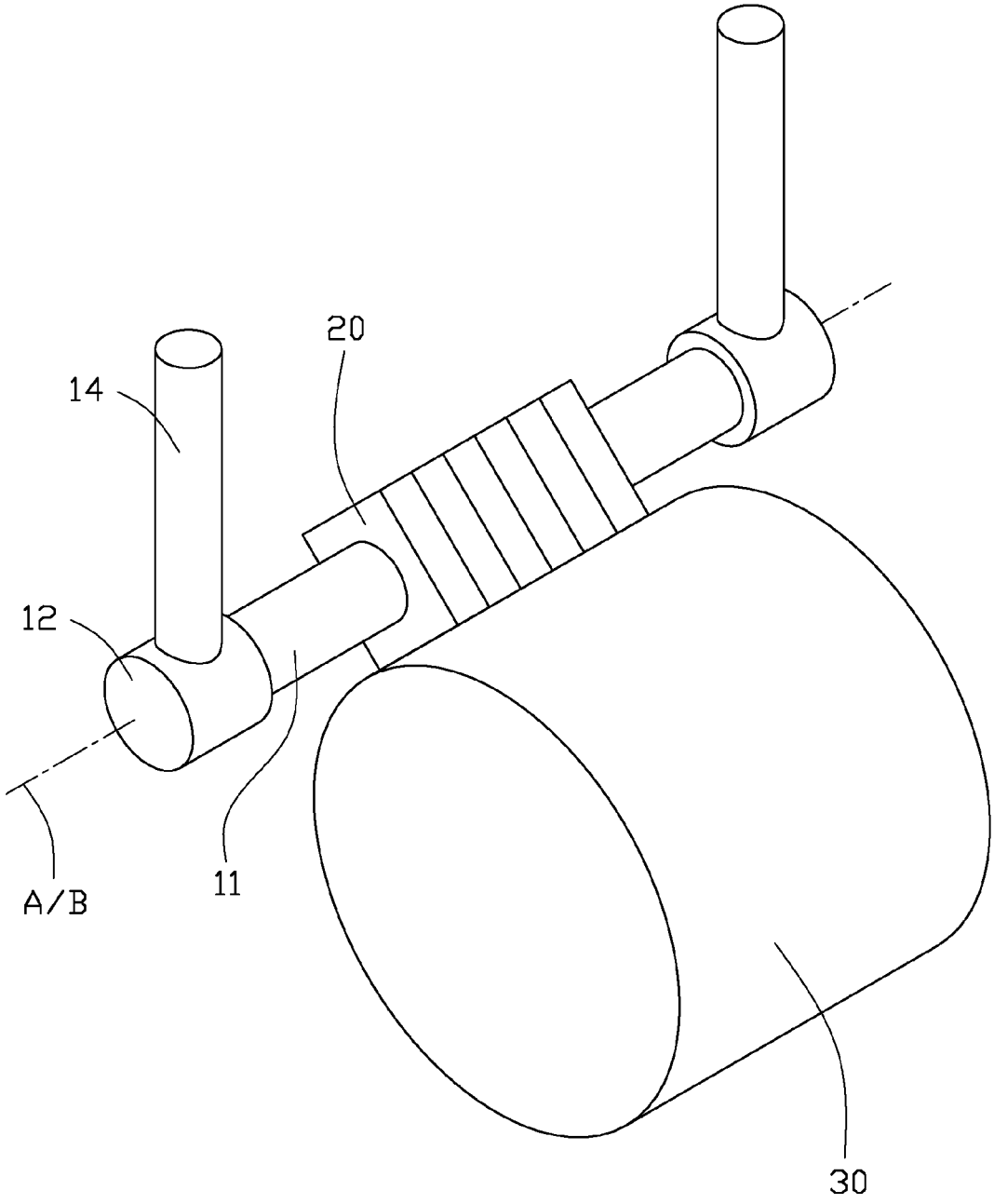
FIG. 4 is an isometric view showing a grinding process using a grinding wheel.

Referring to FIG. 4, the base 13 is removed and the workpieces 20 are driven towards a grinding wheel 30 by the two linear driving members 14. Alternatively, the grinding wheel 30 can also be driven towards the workpieces 20 by a motor (not shown). Then the workpieces 20 are grinded via rotating of the grinding wheel 30. A principal axis of the grinding wheel 30 is parallel with that of the workpieces 20 while the grinding wheel 18 is grinding the workpieces 30.

While the grinding wheel 30 rotates to grind the workpieces 20, the workpieces 20 are driven to rotate about the principal axis A of the two clamping rods 11. The two clamping rod 11 are rotated by the two rotation driving members 12, respectively. Rotation speeds and rotation directions of the two clamping rods 11 must be equal.

Figure 5:
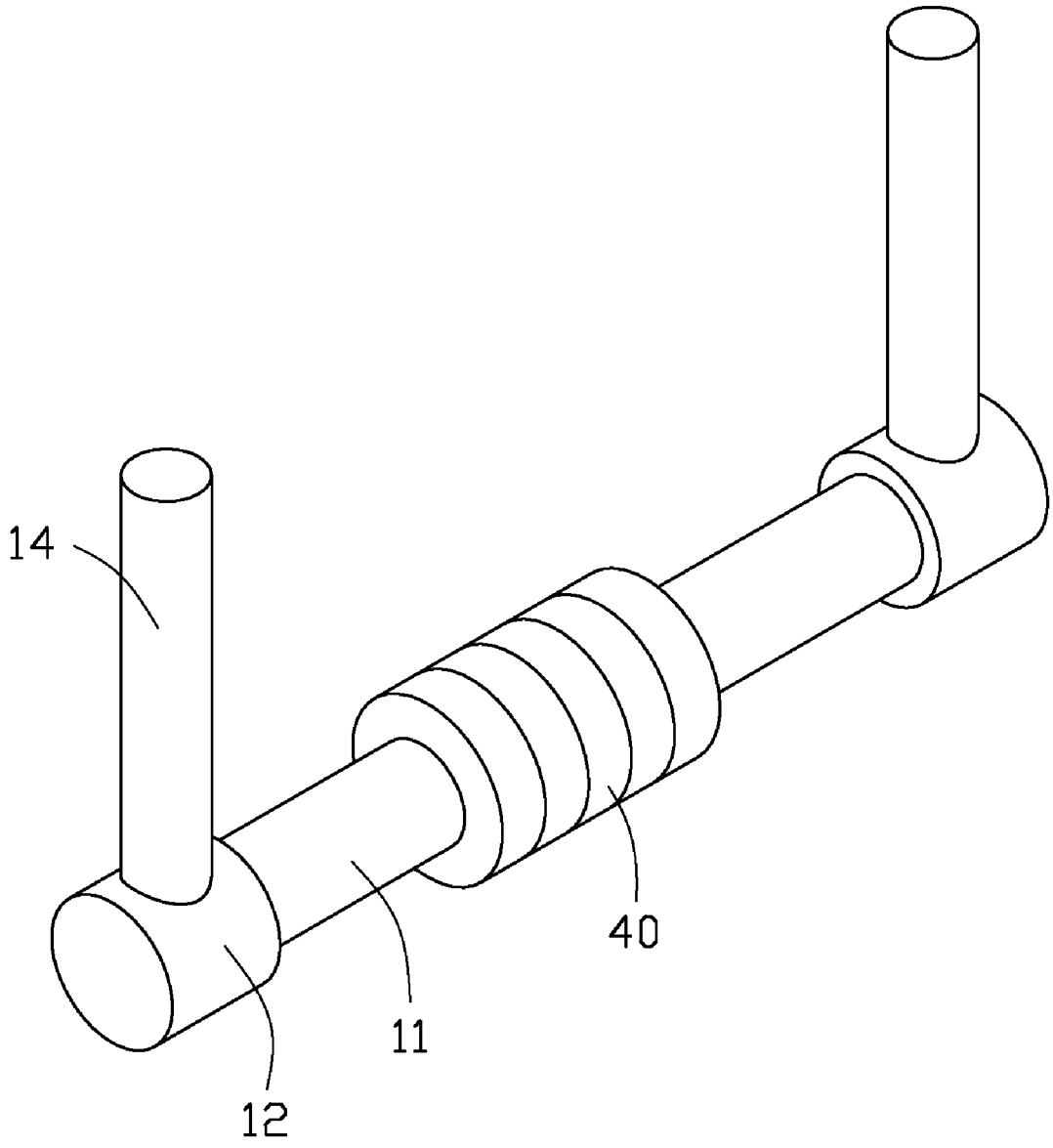
FIG. 5 is an isometric view showing the processed workpieces using the grinding apparatus.

Referring to FIG. 5, after the grinding process is completed, a plurality of finished products 40 is obtained. In the illustrated embodiment, the finished products 40 are rounded products such as rounded lenses.

It is to be understood that the above-described embodiment is intended to illustrate rather than limit the invention. Variations may be made to the embodiment without departing from the spirit of the invention as claimed. The above-described embodiments are intended to illustrate the scope of the invention and not restrict the scope of the invention.

What is claimed is:

1. A grinding apparatus for grinding workpieces, comprising:

two clamping rods each having a first end and an opposite second end, the first ends being opposite to each other for clamping workpieces therebetween;

a base comprising a receiving groove for receiving the workpieces therein and two positioning slots at opposite sides of the receiving groove, a bottom of the slot offset from a bottom of the groove, the positioning slots being aligned with each other and configured for engagingly receiving the clamping rods to align the clamping rods with each other and the workpieces in order to properly engage the workpieces for holding during a grinding operation once removed from the base; and a grinding wheel configured for grinding the workpieces held by the rods.

2. The grinding apparatus of claim 1, further comprising two rotation driving members connected with the respective second ends of the clamping rods, the rotation driving members being configured for driving the two clamping rods to rotate about a common axis.

3. The grinding apparatus of claim 2, further comprising two linear driving members connected with the respective rotation driving members for driving the rotation driving members to move in a direction perpendicular to lengthwise directions of the respective clamping rods.

4. The grinding apparatus of claim 1, wherein the receiving groove is a V-shaped groove.

5. The grinding apparatus of claim 4, wherein a cross-section of the receiving groove has an isosceles right triangle shape.

6. The grinding apparatus of claim 1, wherein each of the clamping rods has a cylindrical shape.

7. The grinding apparatus of claim 6, wherein each of the positioning slots has a shape conforming to the shape of the corresponding clamping rod.

8. The grinding apparatus of claim 2, wherein each of the rotation driving members is selected from the group consisting of a rotating gas cylinder and a servo motor.

9. The grinding apparatus of claim 1, wherein a diameter of the each clamping rods is substantially the same as that of the corresponding positioning slot.

10. The grinding apparatus of claim 6, wherein each of the positioning slots has a U-shape with a constant radius of curvature, and the radius of curvature of each positioning slot is substantially equal to that of the corresponding clamping rod such that the wall of the positioning slot matingly contacts the clamping rod.

* * * * *